US007471922B2

(12) United States Patent
Robles-Flores et al.

(10) Patent No.: US 7,471,922 B2
(45) Date of Patent: Dec. 30, 2008

(54) SEGMENTED TRANSFER ASSIST BLADE

(75) Inventors: Eliud Robles-Flores, Webster, NY (US); Bruce J. Parks, Bloomfield, NY (US); Edward W. Schnepf, Ontario, NY (US); David Montfort, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 402 days.

(21) Appl. No.: 11/359,168

(22) Filed: Feb. 22, 2006

(65) Prior Publication Data

US 2007/0196144 A1 Aug. 23, 2007

(51) Int. Cl.
*G03G 15/16* (2006.01)

(52) U.S. Cl. ..... 399/316

(58) Field of Classification Search ..... 399/45, 399/66, 311, 316, 317, 318, 388, 389
See application file for complete search history.

(56) References Cited

U.S. PATENT DOCUMENTS 5,539,508 A * 7/1996 Piotrowski et al. ..... 399/170
6,032,004 A 2/2000 Mirabella, Jr. et al.
6,134,398 A 10/2000 Grace
6,556,805 B1 * 4/2003 Kuo et al. ..... 399/316
6,606,478 B2 * 8/2003 Fayette et al. ..... 399/316
6,687,480 B2 * 2/2004 Obrien et al. ..... 399/316
6,766,138 B2 * 7/2004 Obrien et al. ..... 399/316
7,315,701 B2 * 1/2008 Soures et al. ..... 399/16
2003/0108369 A1 * 6/2003 Kuo et al. ..... 399/310
2006/0216075 A1 * 9/2006 Sugawara et al. ..... 399/316

* cited by examiner

*Primary Examiner*—Robert Beatty
(74) *Attorney, Agent, or Firm*—Gibb Intellectual Property Law Firm, LLC

(57) ABSTRACT

Embodiments herein include a transfer assist blade that is adapted to bias media toward a marking device. The transfer assist blade has a plurality of movable blade segments that overlap one another. In one embodiment, a first movable blade segment (comprising a first wear layer and a first underlying layer beneath the first wear layer) overlies a second movable blade segment (comprising a second wear layer and a second underlying layer beneath the first wear layer). More specifically, in this embodiment, a portion of the first wear layer overlaps a portion of the second wear layer.

20 Claims, 5 Drawing Sheets

SEGMENTED TRANSFER ASSIST BLADE

BACKGROUND

Embodiments herein generally relate to electrostatographic printers and copiers or reproduction machines, and more particularly, concerns a segmented transfer assist blade assembly in which segments of the blade are engaged for contacting an image receiving sheet.

The process of transferring charged toner particles from an image bearing member marking device (e.g. photoreceptor) to an image support substrate (e.g., sheet) is enabled by overcoming cohesive forces holding the toner particles to the image bearing member. The interface between the photoreceptor surface and image support substrate is not always optimal. Thus, problems may be caused in the transfer process when spaces or gaps exist between the developed image and the image support substrate. A critical aspect of the transfer process is focused on the application and maintenance of high intensity electrostatic fields in the transfer region for overcoming the cohesive forces acting on the toner particles as they rest on the photoreceptive member. Careful control of these electrostatic fields and other forces is required to induce the physical detachment and transfer-over of the charged toner particles without scattering or smearing the developer material. Mechanical devices that force the image support substrate into intimate and substantially uniform contact with the image bearing surface have been incorporated into transfer systems. Various contact blade arrangements have been proposed for sweeping the backside of the image support substrate, with a constant force, at the entrance to the transfer region.

In some conventional transfer assist blade assemblies each segmented blade is actuated by a separate solenoid, so that such an assembly with four independent segmented blades requires four separate solenoids. In other conventional transfer assist blade assemblies as disclosed for example in U.S. Pat. No. 6,134,398, the complete disclosure of which is incorporated herein by reference, the engagement timing and the width adjustment of the segmented blades are under separate mechanical controls, and the blade width adjustment is separately controlled by a rack and pinion mechanism.

SUMMARY

Embodiments herein include a transfer assist blade that is adapted to bias media toward a marking device. The transfer assist blade has a plurality of movable blade segments that overlap one another. In one embodiment, a first movable blade segment (comprising a first wear layer and a first underlying layer beneath the first wear layer) overlies a second movable blade segment (comprising a second wear layer and a second underlying layer beneath the first wear layer). More specifically, in this embodiment, a portion of the first wear layer overlaps a portion of the second wear layer.

Actuators are operatively connected to the first movable blade segment and the second movable blade segment and at least one controller is operatively connected to the actuators. The controller is adapted to individually activate the actuators to individually control positions the first and second movable blade segments. The first movable blade segment and the second movable blade segment are positioned to overlap one another in a manner such that gaps between the first and second movable blade segments are avoided and to allow the first and second movable blade segments to freely move with respect to one another.

A printing apparatus embodiment comprises a marking device and the aforementioned transfer assist blade positioned adjacent the marking device. For example, the marking device can comprise an electrostatographic device, xerographic device, etc. These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 5:
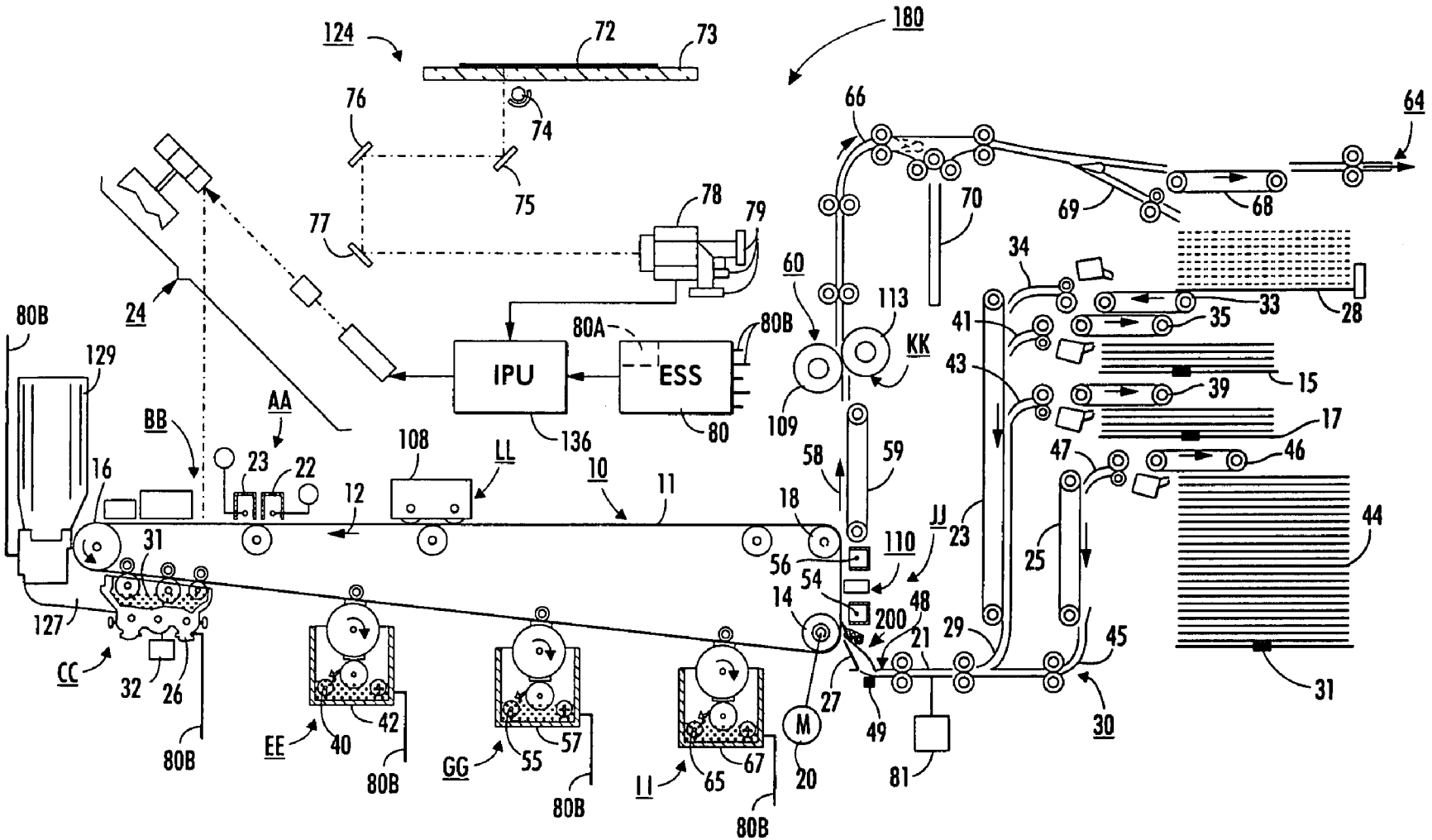
FIG. 5 is a schematic diagram of a printing device.

The embodiments herein are useful with printing/copying devices, such as those discussed in U.S. Patent Application 2003/0108369, the complete disclosure of which is incorporated herein by reference, and portions of which are incorporated herein. Referring first to FIG. 5, there is depicted an exemplary electrostatographic reproduction machine, for example, a multipass color electrostatographic reproduction machine 180. As is well known, the color copy process typically involves a computer generated color image which may be conveyed to an image processor 136, or alternatively a color document 72 which may be placed on the surface of a transparent platen 73. A scanning assembly 124, having a light source 74 illuminates the color document 72. The light reflected from document 72 is reflected by mirrors 75, 76, and 77, through lenses (not shown) and a dichroic prism 78 to three charged-coupled linear photosensing devices (CCDs) 79 where the information is read. Each CCD 79 outputs a digital image signal the level of which is proportional to the intensity of the incident light. The digital signals represent each pixel and are indicative of blue, green, and red densities. They are conveyed to the IPU 136 where they are converted into color separations and bit maps, typically representing yellow, cyan, magenta, and black. IPU 136 stores the bit maps for further instructions from an electronic subsystem (ESS) 80 including the sequential transfer assist blade assembly 200 (FIG. 6) (to be described in detail below).

The ESS is preferably a self-contained, dedicated minicomputer having a central processor unit (CPU), electronic storage, and a display or user interface (UI). The ESS is the control system which, with the help of sensors, and connections 80B as well as a pixel counter 80A, reads, captures, prepares and manages the image data flow between IPU 136 and image input terminal 124. In addition, the ESS 80 is the main multi-tasking processor for operating and controlling all of the other machine subsystems and printing operations. These printing operations include imaging, development, sheet delivery and transfer, and particularly control of the sequential transfer assist blade assembly. Such operations also include various functions associated with subsequent finishing processes. Some or all of these subsystems may have micro-controllers that communicate with the ESS 80.

The multipass color electrostatographic reproduction machine 180 employs a photoreceptor 10 in the form of a belt having a photoconductive surface layer 11 on an electroconductive substrate. The surface 11 can be made from an organic photoconductive material, although numerous photoconductive surfaces and conductive substrates may be employed. The belt 10 is driven by means of motor 20 having an encoder attached thereto (not shown) to generate a machine timing clock. Photoreceptor 10 moves along a path defined by rollers 14, 18, and 16 in a counter-clockwise direction as shown by arrow 12.

Initially, in a first imaging pass, the photoreceptor 10 passes through charging station AA where a corona generating devices, indicated generally by the reference numeral 22, 23, on the first pass, charge photoreceptor 10 to a relatively high, substantially uniform potential. Next, in this first imaging pass, the charged portion of photoreceptor 10 is advanced through an imaging station BB. At imaging station BB, the uniformly charged belt 10 is exposed to the scanning device 24 forming a latent image by causing the photoreceptor to be discharged in accordance with one of the color separations and bit map outputs from the scanning device 24, for example black. The scanning device 24 is a laser Raster Output Scanner (ROS). The ROS creates the first color separatism image in a series of parallel scan lines having a certain resolution, generally referred to as lines per inch. Scanning device 24 may include a laser with rotating polygon mirror blocks and a suitable modulator, or in lieu thereof, a light emitting diode array (LED) write bar positioned adjacent the photoreceptor 10.

At a first development station CC, a non-interactive development unit, indicated generally by the reference numeral 26, advances developer material 31 containing carrier particles and charged toner particles at a desired and controlled concentration into contact with a donor roll, and the donor roll then advances charged toner particles into contact with the latent image and any latent target marks. Development unit 26 may have a plurality of magnetic brush and donor roller members, plus rotating augers or other means for mixing toner and developer.

A special feature of non-interactive development is that adding and admixing can continue even when development is disabled. Therefore the timing algorithm for the adding and admixing function can be independent of that for the development function, as long as admixing is enabled whenever development is required. These donor roller members transport negatively charged black toner particles for example, to the latent image for development thereof which tones the particular (first) color separation image areas and leaves other areas untoned. Power supply 32 electrically biases development unit 26. Development or application of the charged toner particles as above typically depletes the level and hence concentration of toner particles, at some rate, from developer material in the development unit 26. This is also true of the other development units (to be described below) of the machine 180.

Accordingly, different jobs of several documents being reproduced, will cause toner depletion at different rates depending on the sustained, copy sheet area toner coverage level of the images thereof being reproduced. In a machine using two component developer material as here, such depletion undesirably changes the concentration of such particles in the developer material. In order to maintain the concentration of toner particles within the developer material (in an attempt to insure the continued quality of subsequent images), the adding and admixing function of the development unit will be operating or turned "on" for some controlled period of time in order for the device 127 to replenish the development unit such as 26 with fresh toner particles from the source 129. Such fresh toner particles must then be admixed with the carrier particles in order to properly charge them triboeletrically.

On the second and subsequent passes of the multipass machine 180, the pair of corona devices 22 and 23 are employed for recharging and adjusting the voltage level of both the toned (from the previous imaging pass), and untoned areas on photoreceptor 10 to a substantially uniform level. A power supply is coupled to each of the electrodes of corona recharge devices 22 and 23. Recharging devices 22 and 23 substantially eliminate any voltage difference between toned areas and bare untoned areas, as well as to reduce the level of residual charge remaining on the previously toned areas, so that subsequent development of different color separation toner images is effected across a uniform development field.

Imaging device 24 is then used on the second and subsequent passes of the multipass machine 180, to superimpose subsequent a latent image of a particular color separation image, by selectively discharging the recharged photoreceptor 10. The operation of imaging device 24 is of course controlled by the controller, ESS 80. One skilled in the art will recognize that those areas developed or previously toned with black toner particles will not be subjected to sufficient light from the imaging device 24 as to discharge the photoreceptor region lying below such black toner particles. However, this is of no concern as there is little likelihood of a need to deposit other colors over the black regions or toned areas.

Thus on a second pass, imaging device 24 records a second electrostatic latent image on recharged photoreceptor 10. Of the four development units, only the second development unit 42, disposed at a second developer station EE, has its development function turned "on" (and the rest turned "off") for developing or toning this second latent image. As shown, the second development unit 42 contains negatively charged developer material 40, for example, one including yellow toner. The toner 40 contained in the development unit 42 is thus transported by a donor roll to the second latent image recorded on the photoreceptor 10, thus forming additional toned areas of the particular color separation on the photoreceptor 10. A power supply (not shown) electrically biases the development unit 42 to develop this second latent image with the negatively charged yellow toner particles 40. As will be further appreciated by those skilled in the art, the yellow colorant is deposited immediately subsequent to the black so that further colors that are additive to yellow, and interact therewith to produce the available color gamut, can be exposed through the yellow toner layer.

On the third pass of the multipass machine 180, the pair of corona recharge devices 22 and 23 are again employed for recharging and readjusting the voltage level of both the toned and untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas, as well as to reduce the level of residual charge remaining on the previously toned areas so that subsequent development of different color toner images is effected across a uniform development field. A third latent image is then again recorded on photoreceptor 10 by imaging device 24. With the development functions of the other development units turned "off", this image is developed in the same manner as above using a third color toner 55 contained in a development unit 57 disposed at a third developer station GG. An example of a suitable third color toner is magenta. Suitable electrical biasing of the development unit 57 is provided by a power supply, not shown.

On the fourth pass of the multipass machine 180, the pair of corona recharge devices 22 and 23 again recharge and adjust the voltage level of both the previously toned and yet untoned areas on photoreceptor 10 to a substantially uniform level. A power supply is coupled to each of the electrodes of corona recharge devices 22 and 23. The recharging devices 22 and 23 substantially eliminate any voltage difference between toned areas and bare untoned areas as well as to reduce the level of residual charge remaining on the previously toned areas. A fourth latent image is then again created using imaging device 24. The fourth latent image is formed on both bare areas and previously toned areas of photoreceptor 10 that are to be developed with the fourth color image. This image is developed in the same manner as above using, for example, a cyan color toner 65 contained in development unit 67 at a fourth developer station II. Suitable electrical biasing of the development unit 67 is provided by a power supply, not shown.

Following the black development unit 26, development units 42, 57, and 67 are preferably of the type known in the art which do not interact, or are only marginally interactive with previously developed images. For examples, a DC jumping development system, a powder cloud development system, or a sparse, non-contacting magnetic brush development system are each suitable for use in an image on image color development system as described herein. In order to condition the toner for effective transfer to a substrate, a negative pretransfer corotron member 50 negatively charges all toner particles to the required negative polarity to ensure proper subsequent transfer.

Since the machine 180 is a multicolor, multipass machine as described above, only one of the plurality of development units, 26, 42, 57 and 67 may have its development function turned "on" and operating during any one of the required number of passes, for a particular color separation image development. The remaining development units thus have their development functions turned off.

During the exposure and development of the last color separation image, for example by the fourth development unit 65, 67 a sheet SS of support material is advanced to a transfer station JJ by a sheet feeding apparatus 30. During simplex operation (single sided copy), a blank sheet SS may be fed from tray 15 or tray 17, or a high capacity tray 44 could thereunder, to a registration transport 21, in communication with controller 81, where the sheet is registered in the process and lateral directions, and for skew position. As shown, the tray 44 and each of the other sheet supply sources includes a sheet size sensor 31 that is connected to the controller 80. One skilled in the art will realize that trays 15, 17, and 44 each hold a different sheet type.

The speed of the sheet SS is adjusted at registration transport 21 so that the sheet arrives at transfer station JJ in synchronization with the composite multicolor image on the surface of photoconductive belt 10. Registration transport 21 receives a sheet from either a vertical transport 23 or a high capacity tray transport 25 and moves the received sheet to pretransfer baffles 27. The vertical transport 23 receives the sheet from either tray 15 or tray 17, or the single-sided copy from duplex tray 28, and guides it to the registration transport 21 via a turn baffle 29. Sheet feeders 35 and 39 respectively advance a copy sheet SS from trays 15 and 17 to the vertical transport 23 by chutes 41 and 43. The high capacity tray transport 25 receives the sheet from tray 44 and guides it to the registration transport 21 via a lower baffle 45. A sheet feeder 46 advances copy sheets SS from tray 44 to transport 25 by a chute 47.

As shown, pretransfer baffles 27 guide the sheet SS from the registration transport 21 to transfer station JJ. Charge limiter 49 located on pretransfer baffles 27 restricts the amount of electrostatic charge a sheet can place on the baffles 27 thereby reducing image quality problems and shock hazards. The charge can be placed on the baffles from either the movement of the sheet through the baffles or by the corona generating devices 54, 56 located at transfer station JJ. When the charge exceeds a threshold limit, charge limiter 49 discharges the excess to ground.

Transfer station JJ includes a transfer corona device 54 which provides positive ions to the backside of the copy sheet SS. This attracts the negatively charged toner powder images from photoreceptor belt 10 to the sheet SS. A detack corona device 56 is provided for facilitating stripping of the sheet SS from belt 10. A sheet-to-image registration detector 110 is located in the gap between the transfer and corona devices 54 and 56 to sense variations in actual sheet to image registration and provides signals indicative thereof to ESS 80 and controller 81 while the sheet SS is still tacked to photoreceptor belt 10.

The transfer station JJ also includes the transfer assist blade assembly 200, (to be described in detail below) in which various segmented blades are engaged for contacting the backside of the image receiving sheet SS. After transfer, the sheet SS continues to move, in the direction of arrow 58, onto a conveyor 59 that advances the sheet to fusing station KK.

Fusing station KK includes a fuser assembly, indicated generally by the reference numeral 60, which permanently fixes the transferred color image to the copy sheet. Preferably, fuser assembly 60 comprises a heated fuser roller 109 and a backup or pressure roller 113. The copy sheet passes between fuser roller 109 and backup roller 113 with the toner powder image contacting fuser roller 109. In this manner, the multicolor toner powder image is permanently fixed to the sheet. After fusing, chute 66 guides the advancing sheet to feeder 68 for exit to a finishing module (not shown) via output 64. However, for duplex operation, the sheet is reversed in position at inverter 70 and transported to duplex tray 28 via chute 69. Duplex tray 28 temporarily collects the sheet whereby sheet feeder 33 then advances it to the vertical transport 23 via chute 34. The sheet fed from duplex tray 28 receives an image on the second side thereof, at transfer station JJ, in the same manner as the image was deposited on the first side thereof The completed duplex copy exits to the finishing module (not shown) via output 64.

After the sheet of support material is separated from photoreceptor 10, the residual toner carried on the photoreceptor surface is removed therefrom. The toner is removed for example at cleaning station LL using a cleaning brush structure contained in a unit 108.

Figure 6:
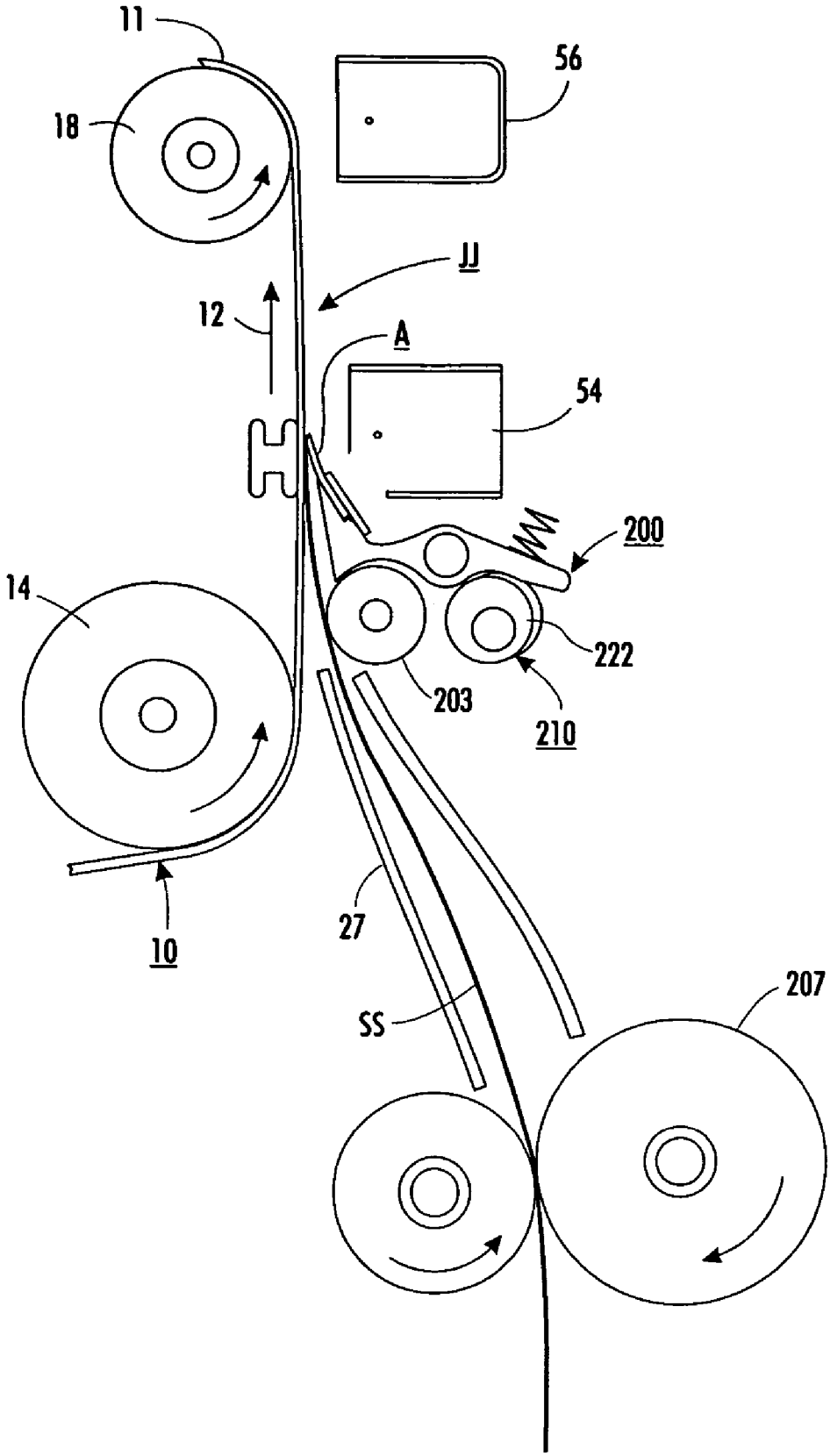
FIG. 6 is a schematic diagram of a transfer blade assist assembly.
Figure 7:
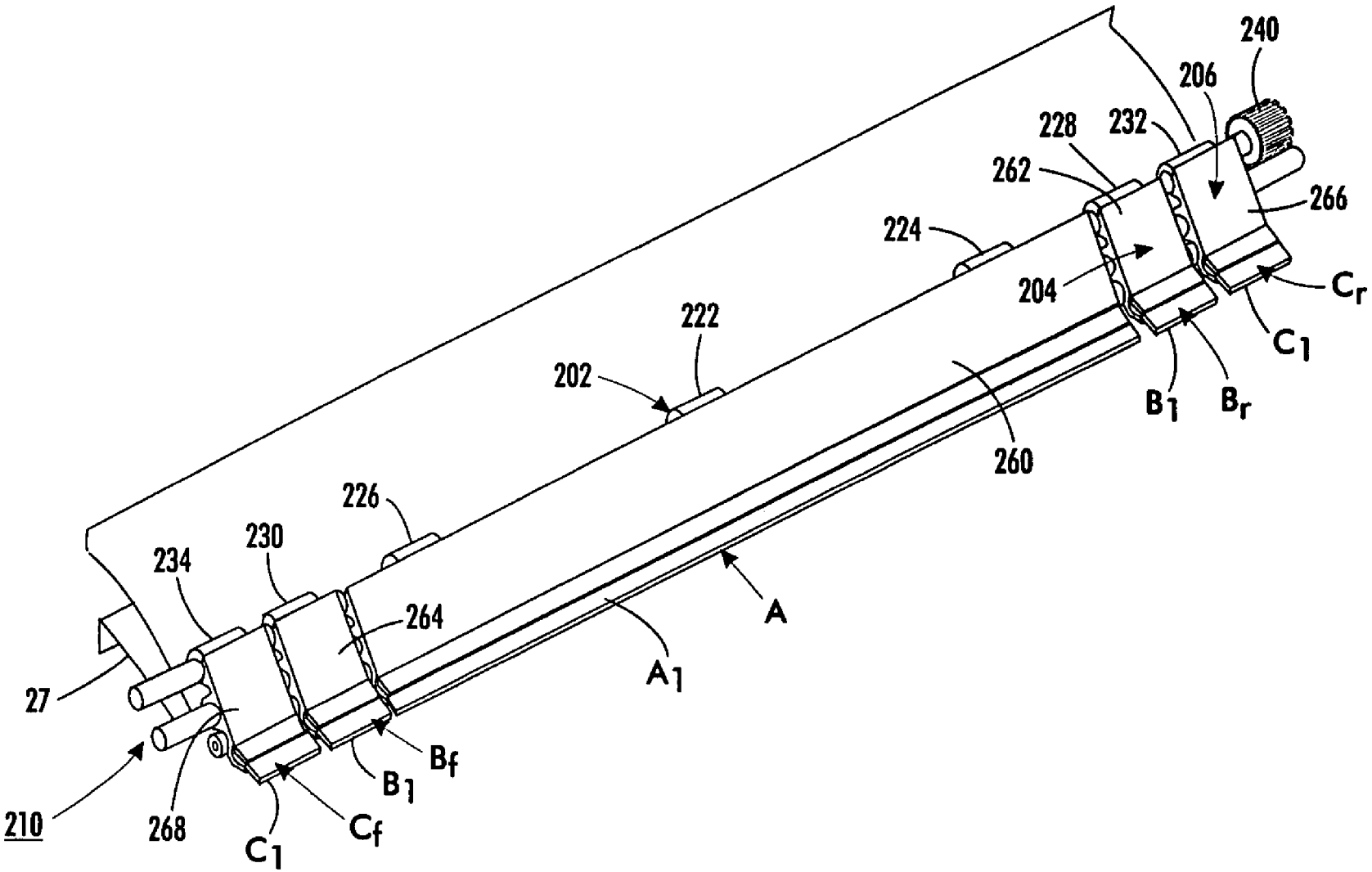
FIG. 7 is a schematic diagram of a transfer assist blade.

Referring now to FIGS. 6 and 7, the transfer assist blade assembly 200 as variously illustrated includes a first cam and blade assembly 202 comprises a first blade segment A having a first length (A1) and being movable for first contacting a first size image receiving sheet SS. The sequential transfer assist blade assembly 200 includes baffles 27, an idle roll 203, the cam shaft assembly 210, and the segmented blades A, Bf, Br, Cf, Cr. Also shown are (i) registration rolls 207 for providing input sheets SS to the transfer station JJ and (ii) corotron devices 54, 56 for applying electrostatic charge to sheets SS at the transfer station JJ It also comprises a second cam and blade assembly 204 including a second blade segment Bf and a third blade segment Br each having a second length (B1), and each being located adjacent a first end and a second end respectively of the first blade segment A as shown.

FIG. 7 shows alignment of the cams against their corresponding blade segments A, Bf, Br, and Cf, Cr. For a center-registration system, for example, each of the first or middle three cams 222, 224, 226 (for the segment A blade) includes a significantly long cam lobe having a constant radius for dwell, and together are arranged for engaging and contacting the middle blade (segment A blade) which is the narrowest of the three sheet widths. Each of the next two, or the second and third cams 228, 230 (for the segment Bf, Br blades) includes a reduced length cam lobe that has a constant radius for dwell, and as shown, they are located on opposite sides of the first or middle cams 222, 224, 226. As such, they correspond to, and are suitable for engaging the two segment Bf, Br blades on either side of the central segment A blade. Together with the first or middle cams 222, 224, 226, these second and third cams 228, 230 are sufficient for engaging and contacting the middle blade (segment A blade) and the segment Bf, Br blades which correspond to the next size sheet width. Similarly, the outer most or the fourth and fifth cams 232, 234 include the narrowest cam lobe that has a constant radius for dwell, and are placed for engaging the outer most blades (Cf, Cr blades) for the widest sheet width. The sequential transfer assist blade assembly 200 further comprises a third cam and blade assembly 206 including a fourth blade segment Cf and a fifth blade segment Cr each having a third length (C1), and each being located adjacent the second blade segment and the third blade segment respectively. The sequential transfer-assist blade assembly 200, in addition to the cam shaft assembly 210, further comprises plural blade support levers including first 260, second 262, third 264, fourth 266 and fifth 268 blade support levers, each of which is pivotable. The cam shaft assembly 210 also includes a drive means in the form of a stepper motor 240 for rotatably moving the rotatable cam shaft.

Figure 1:
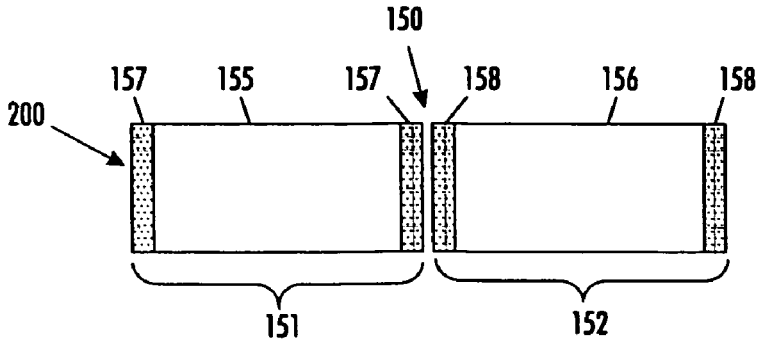
FIG. 1 is a schematic diagram of a portion of a transfer assist blade.

FIG. 1 is a simplified schematic diagram of a portion of the transfer assist blade 200 that includes wear layer segments 155, 156, and underlying layer segments 157, 158 beneath the wear layer segments 155, 156. In FIG. 1 a gap 150 exists between the segments 151, 152, which can cause streaking.

More specifically, printing devices commonly use the transfer assist blade to achieve the best transfer performance possible. The transfer assist blade systems may be built of single or multiple layers of insulative, conductive, semi-conductive, or wear material in order to accomplish various functions such as high force, life, and electric response. Also, in some cases transfer assist blade systems incorporate media width adjustment to insure proper transfer in all media widths possible. Some use a segmented transfer assist blade, in which the blade material is slit in small segments or petals which can be actuated independently and hence conform to media width as necessary. Each of these segments is free to engage independently, assuming proper spacing between segments. If this spacing is too large (and environmental/media conditions are in a certain stress condition) a streak artifact may be induced, which resembles the transfer assist blade segment structure. Such artifacts are called transfer assist blade segment-slit streaks.

Figure 2:
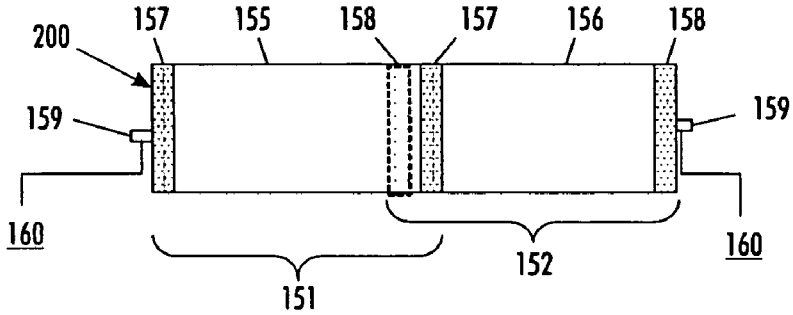
FIG. 2 is a schematic diagram of a portion of a transfer assist blade.

Thus, as shown in FIG. 2, embodiments herein include a transfer assist blade 200 that is adapted to bias media toward a marking device. The transfer assist blade 200 has a plurality of movable blade segments that overlap one another, two of which (151, 152) are shown in FIG. 2. While FIG. 2 illustrates two segments 151, 152, one ordinarily skilled in the art would understand that all segments could overlap adjacent segments in the transfer assist blades according to embodiments herein.

Figure 3:
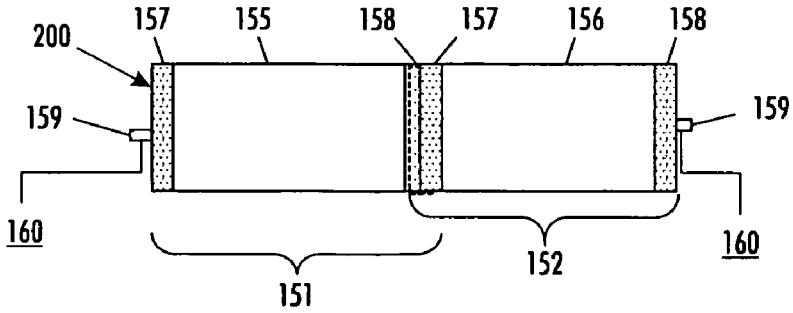
FIG. 3 is a schematic diagram of a portion of a transfer assist blade.

In one embodiment, the first movable blade segment 151 (comprising a first wear layer 155 and a first underlying layer 157 overlies the second movable blade segment 152 (comprising a second wear layer 156 and a second underlying layer 158 which can be seen beneath the first wear layer 156 using dashed lines). More specifically, in this embodiment, a portion of the first wear layer 155 overlaps a portion of the second wear layer 156 as shown by the dashed lines in FIG. 2. Alternatively, just the underlying layers 157, 158 could overlap, as shown in FIG. 3.

One exemplary overlap between blade segment could be assigned to provide a maximum of 0.7 mm of overlap, and a minimum of zero overlap (although one ordinarily skilled in the art would understand that the embodiments herein could work with any amount of overlap, depending upon the specific design, and that the foregoing amount of overlap is merely a simplified example used to illustrate the embodiments herein). In each case, the blade segments can operate in the same fashion as they do when there was no overlap (original design). The lifters (which are responsible for actuating the petals (blade segments)).only operate from outboard to inboard (engaged position to non-engaged position) in the machine, making this operation unidirectional. As such, there is no risk of petals getting entangled while the machine is in normal operation.

Figure 4:
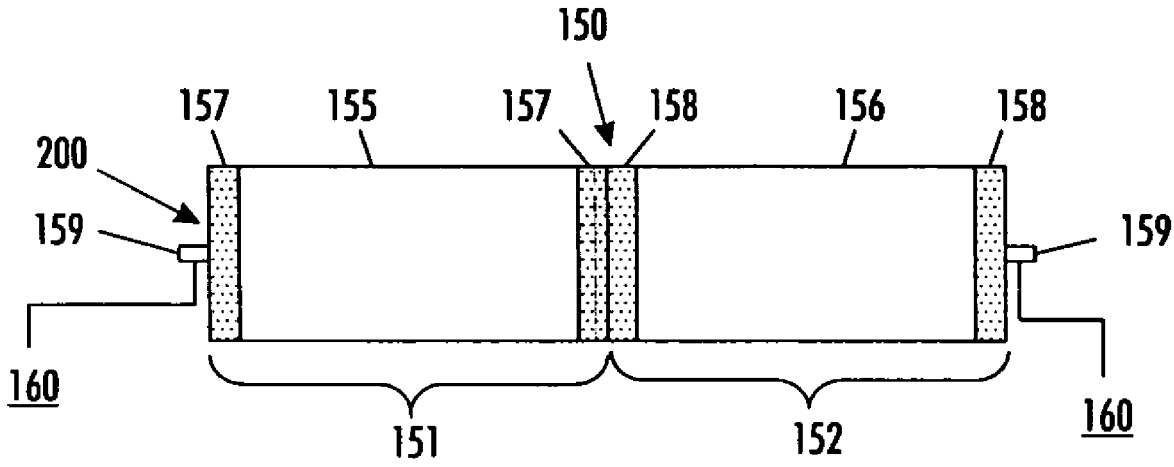
FIG. 4 is a schematic diagram of a portion of a transfer assist blade.

As discussed above actuators 159, such as cams, solenoids, piezo-electric devices, or electrical motors, are operatively connected to the first movable blade segment 151 and the second movable blade segment 152 and at least one controller 160 is operatively connected to the actuators 159. The controller 160 is adapted to individually activate the actuators 159 to individually control positions the first and second movable blade segments 151, 152. The first movable blade segment 151 and the second movable blade segment are positioned to overlap one another in a manner such that gaps between the first and second movable blade segments 151, 152 are avoided and to allow the first and second movable blade segments 151, 152 to freely move with respect to one another. Thus, in some embodiments, such as the one shown in FIG. 4, there is no overlap (or an insignificant overlap) yet no gap 150 (or an insignificant gap).

A printing apparatus embodiment comprises a marking device and the aforementioned transfer assist blade positioned adjacent the marking device. For example, the marking device can comprise an electrostatographic device, xerographic device, etc.

The word "printer" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The following claims can encompass embodiments that print in monochrome, color or handle color image data. All foregoing embodiments are specifically applicable to electrostatographic and/or xerographic machines and/or processes.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof.

What is claimed is:

1. A segmented transfer assist blade adapted to bias media toward a marking device, said segmented transfer assist blade comprising:

a first blade segment independently movable toward said marking device; and a second blade segment independently movable toward said marking device, wherein said first blade segment overlaps said second blade segment.

2. The segmented transfer assist blade according to claim 1, further comprising actuators operatively connected to said first blade segment and said second blade segment.

3. The segmented transfer assist blade according to claim 2, further comprising at least one controller operatively connected to said actuators, wherein said controller is adapted to individually activate said actuators to individually control a position of each of said first blade segment and said second blade segment with respect to said marking device.

4. The segmented transfer assist blade according to claim 1, wherein said first blade segment and said second blade segment are positioned to overlap one another in a manner such that gaps between said first blade segment and said second blade segment are avoided.

5. The segmented transfer assist blade according to claim 1, wherein said first blade segment and said second blade segment are positioned to overlap in a manner that allows adjacent first blade segment and said second blade segment to freely move with respect to one another.

6. A segmented transfer assist blade adapted to bias media toward a marking device, said segmented transfer assist blade comprising:

a first blade segment independently movable toward said marking device, wherein said first blade segment comprises:

a first overlying layer; and a first underlying layer beneath said first overlying layer; and a second blade segment independently movable toward said marking device, wherein said second blade segment comprises:

a second overlying layer; and a second underlying layer beneath said first overlying layer, wherein a portion of said first overlying layer overlaps a portion of said second overlying layer.

7. The segmented transfer assist blade according to claim 6, further comprising actuators operatively connected to said first blade segment and said second blade segment.

8. The segmented transfer assist blade according to claim 7, further comprising at least one controller operatively connected to said actuators, wherein said controller is adapted to individually activate said actuators to individually control a position of each of said first blade segment and said second blade segment with respect to said marking device.

9. The segmented transfer assist blade according to claim 6, wherein said first blade segment and said second blade segment are positioned to overlap one another in a manner such that gaps between said first blade segment and said second blade segment are avoided.

10. The segmented transfer assist blade according to claim 6, wherein said first blade segment and said second blade segment are positioned to overlap in a manner that allows adjacent first blade segment and said second blade segment to freely move with respect to one another.

11. A segmented transfer assist blade adapted to bias media toward a marking device, said segmented transfer assist blade comprising:

a first blade segment independently movable toward said marking device, wherein said first blade segment comprises:

a first wear layer; and a first underlying layer beneath said first wear layer; and a second blade segment independently movable toward said marking device, wherein said second blade segment comprises:

a second wear layer; and a second underlying layer beneath said first wear layer, wherein a portion of said first wear layer overlaps a portion of said second wear layer.

12. The segmented transfer assist blade according to claim 11, further comprising actuators operatively connected to said first blade segment and said second blade segment.

13. The segmented transfer assist blade according to claim 12, further comprising at least one controller operatively connected to said actuators, wherein said controller is adapted to individually activate said actuators to individually control a position of each of said first blade segment and said second blade segment with respect to said marking device.

14. The segmented transfer assist blade according to claim 11, wherein said first blade segment and said second blade segment are positioned to overlap one another in a manner such that gaps between said first blade segment and said second blade segment are avoided.

15. The segmented transfer assist blade according to claim 11, wherein said first blade segment and said second blade segment are positioned to overlap in a manner that allows adjacent first blade segment and said second blade segment to freely move with respect to one another.

16. A printing apparatus comprising:

a marking device;

a segmented transfer assist blade adjacent said marking device, wherein said segmented transfer assist blade comprises a plurality of blade segments independently movable toward said marking device, wherein said blade segments overlap one another.

17. The printing apparatus according to claim 16, further comprising actuators operatively connected to said blade segments.

18. The printing apparatus according to claim 17, further comprising at least one controller operatively connected to said actuators, wherein said controller is adapted to individually activate said actuators to individually control a position of each of said blade segments with respect to said marking device.

19. The printing apparatus according to claim 16, wherein said blade segments are positioned to overlap one another in a manner such that gaps between said blade segments are avoided.

20. The printing apparatus according to claim 16, wherein said marking device comprises one of an electrostatographic device and a xerographic device.

* * * * *